US006004233A

United States Patent [19]

Raubuck et al.

[11] Patent Number: 6,004,233

[45] Date of Patent: Dec. 21, 1999

[54] ADAPTIVE PHYSICAL EDUCATION DEVICE

[76] Inventors: Daniel Raubuck, 8600 E. Davis Rd., Terre Haute, Ind. 47805; Bruce C. Lautenschlager, 308 S. 13th St., Terre Haute, Ind. 47807

[21] Appl. No.: 09/108,008

[22] Filed: Jun. 30, 1998

Related U.S. Application Data

[63] Continuation-in-part of application No. 08/625,164, Apr. 1, 1996, Pat. No. 5,807,185.

[51] Int. Cl.[6] ..... A63B 65/12; A63B 69/40

[52] U.S. Cl. ..... 473/505; 473/510; 473/513; 473/514; 473/528; 124/20.1; 280/30; 280/250.1; 280/304.1

[58] Field of Search ..... 473/229, 505, 473/510, 513, 514, 528; 124/20.1; 280/30, 250.1, 304.1

[56] References Cited

U.S. PATENT DOCUMENTS

| | | | |
|---|---|---|---|
| 1,173,818 | 2/1916 | Lins | 273/129 |
| 3,341,202 | 9/1967 | Stars | 273/77 |
| 3,410,258 | 11/1968 | Lee | 124/6 |
| 3,598,413 | 8/1971 | Lippert | 273/129 |
| 4,368,898 | 1/1983 | Lay | 280/289 |
| 4,470,598 | 9/1984 | Steele et al. | 273/54 |
| 4,753,449 | 6/1988 | Doucet | 280/289 |
| 4,911,435 | 3/1990 | Johns | 272/134 |
| 4,984,802 | 1/1991 | Barraclough | 273/192 |
| 5,022,656 | 6/1991 | Tiller | 273/186 A |
| 5,363,934 | 11/1994 | Edmund et al. | 180/605 |
| 5,807,185 | 9/1998 | Raubuck et al. | 473/229 |

*Primary Examiner*—George J. Marlo
*Attorney, Agent, or Firm*—Thomas E. Coverstone

[57] ABSTRACT

An adaptive physical education device has a spring-back assembly with a U shaped frame that is positioned over first and second vertical posts. The spring-back assembly has a webbing attached by springs to a webbing frame, which is pivotally attached to the U shaped frame. The spring-back assembly is pivotable to different angles so that a ball may be caught and tossed at a variety of angles. In a separate embodiment, the webbing frame is removed and replaced with a ball catapult assembly, which is attached to the U shaped frame with elastic cords. The ball catapult assembly has a ball holder and a handle. A ball is placed in the ball holder, then a wheelchair bound participant pulls back the handle to apply tension to the elastic cords. The handle is released to propel the ball.

11 Claims, 12 Drawing Sheets

ADAPTIVE PHYSICAL EDUCATION DEVICE

This is a continuation in part application from Ser. No. 08/625,164 filed on Apr. 1, 1996 of Raubuck et al., now issued U.S. Pat. No. 5,807,185 on Sep. 18, 1998.

TECHNICAL FIELD OF THE INVENTION

This invention relates to physical education devices, and more particularly, to physical education devices designed for use by handicapped or wheel chair bound participants.

BACKGROUND OF THE INVENTION

In many public supported schools, physical education is a course that is required curriculum. Therefore, in many physical education classes while the average person is participating in kickball, softball, hockey and basketball the handicapped people are left with an inactive role, such as score keeping, equipment manager or the like.

Nevertheless, a variety of devices have been either specifically developed to include handicapped, wheel chair bound, or otherwise incapacitated people in a wide array of sporting activities, or the devices may be adapted to include the handicapped participant.

For example, U.S. Pat. No. 3,410,258 issued to Lee discloses a device, which propels the ball forward by an lever actuated by the handle when the handle is displaced.

U.S. Pat. No. 3,598,413 issued to Lippert discloses a spring actuated apparatus, wherein the device is mounted atop of a cart, the user aims the device and pulls a trigger, which actuates an arm to strike the ball.

U.S. Pat. No. 4,368,898 issued to Lay discloses a bowling ramp attachment for a wheelchair, wherein the ramp fastens to the front portion of a wheelchair and has a track for aiming and dispensing a ball, such as a bowling ball.

U.S. Pat. No. 4,470,598 issued to Steele et al. discloses a wheelchair bowling device, wherein the device attaches to the front of a wheelchair and has a spring or other propulsion means to propel the ball forward.

U.S. Pat. No. 4,753,449 issued to Doucet discloses a recreation device that attaches to a wheelchair, wherein the device is a bracket that is attached to the wheelchair frame, the bracket has a loop at the user's end so that the loop may hold a ball.

U.S. Pat. No. 4,911,435 issued to Johns discloses exercise equipment that is adaptable to users in wheelchairs.

U.S. Pat. No. 5,363,934 issued to Edmund et al. discloses a wheelchair that is intended for use on the golf course, wherein the seat can be automatically raised so to allow the user to stand and swing a conventional golf club.

Nevertheless, the above mentioned patents have limited use in a physical education environment, especially with severely handicapped students.

Therefore, what is needed is an adaptive physical education device, wherein the device allows a student in a physical education environment to participate in class exercises and even team sports.

DISCLOSURE OF THE INVENTION

It is, therefore, an object of the present invention to provide an adaptive physical education device that allows handicapped people and wheelchair bound people to participate in sporting events.

It is also an object of the present invention to provide an adaptive physical education device that allows handicapped and wheelchair people to participate in team sports, such as baseball and hockey.

It is also an object of the present invention to provide a lightweight adaptive physical education device that may be attached to the front of a wheelchair and be activated or that may be located directly in front of a wheelchair so that the handicapped person can stand directly in front of the wheelchair and activate the device.

It is also an object of the present invention to provide an adaptive physical education device that may be attached to the front of a wheelchair and wherein the device may be adjusted vertically and horizontally so that the device may accommodate a variety of wheelchair and participant sizes, and wherein said adjustment provides the user with a variety of swing choices, such as in the case of a baseball swing, a grounder or a pop fly.

It is also an object of the present invention to provide an adaptive physical education device that is relatively inexpensive to manufacture and assemble.

According to the present invention, an adaptive physical education device has a frame with a variety of attachable components so that the device may be adapted to a variety of sporting applications, such as golf, baseball, hockey, basketball and propelling a ball. The frame, in the preferred embodiment, attaches to the front portion of a wheelchair using a pair of adjustable wheelchair brackets. The frame has a pair of extensions that may be slidably connected to the adjustable wheelchair brackets. The frame has a coupling that allows the mounting of a pivotable golf club. The club is vertically adjustable in relation to the frame; the frame is also vertically and horizontally adjustable via the adjustable wheelchair brackets. An elastic spring means is attached to a pivotable post at one end and to the club at the opposite end. A handle is attached to the club, so that the wheelchair participant may grasp the handle while seated in the wheelchair, pull back the handle, extending the elastic spring means, and let go of the handle, the elastic spring means propels the club forward.

With a few modifications, the golf club may be removed and a baseball bat may then be mounted to the device. First, the club is removed from the frame and then a horizontally pivotable plastic bat is attached to the frame at a first vertical post. A ball holder is positioned at a second vertical post. The elastic spring means is disconnected from the club and attached to the bat. The bat has a handle, so that the wheelchair participant may pull back on the handle extending the elastic spring means, let go the handle, which in turn propels the bat forward, hitting a ball resting in the ball holder. The device is easily adapted to accommodate a left or right handed hitter by switching the bat and the ball holder to the opposite vertical posts.

In a separate embodiment, the components remain the same as the described embodiments, except that a pair of stabilizers are attached to the frame so that the device may be adapted for use with handicapped participants who have the capability to stand up from their wheelchairs. The device may be positioned directly in front of the wheelchair so that the participant may stand up from the wheelchair, strike the ball, then immediately sit back down in the wheelchair.

In yet a separate embodiment, a device to propel a ball is disclosed. A spring-back assembly with a U shaped frame is positioned over the first and second vertical posts. The spring-back assembly has a webbing attached by springs to a webbing frame, which is pivotably attached to the U shaped frame. When a person tosses a ball to the wheelchair participant, the ball is effectively "caught" by the spring-back assembly and then almost simultaneously catapulted or tossed away from the wheelchair participant. The spring-back assembly is pivotable to different angles so that a ball may be caught and tossed at a variety of angles.

In a separate embodiment, another device to propel a ball is disclosed. The webbing and the webbing frame are removed from the spring-back assembly and replaced with a ball catapult assembly, which is attached to the U shaped frame with elastic cords. The ball catapult assembly has a ball holder and a handle. A ball is placed in the ball holder, then the wheelchair bound participant pulls back on the handle to apply tension to the elastomeric cords, then the handle is released so that the ball is catapulted. This embodiment allows the wheelchair bound participant to propel a basketball towards a basketball hoop.

In yet another embodiment, an isometric exercise device is disclosed. The U shaped frame described above is utilized with a plurality of eye bolts secured around the perimeter of the U shaped frame. A handle with elastomeric cords then is placed onto one eye bolt so that the wheelchair bound participant may perform isometric exercises. A number of elastic cords may be secured to the same handle and at the same eye bolt location to increase the amount of resistance during the exercises.

The device of the present invention allows handicapped and wheelchair bound people to participate in a variety of sporting activities. The device may be adapted with a variety of bats, clubs, or rackets and is not limited to golf, baseball, or hockey. For example, the device could be adapted to swing a tennis racket instead of bat. The first embodiment of use described above with the club describes a vertical swinging motion, which would also be compatible with croquet, cricket, bowling and the like. The second embodiment described above with the bat describes a horizontal swinging motion, which would be compatible with tennis or racquetball. Other embodiments disclose ways to propel a ball.

The foregoing and other advantages of the present invention will become more apparent from the following description and accompanying drawings.

BEST MODE FOR CARRYING OUT THE INVENTION

Figure 1:
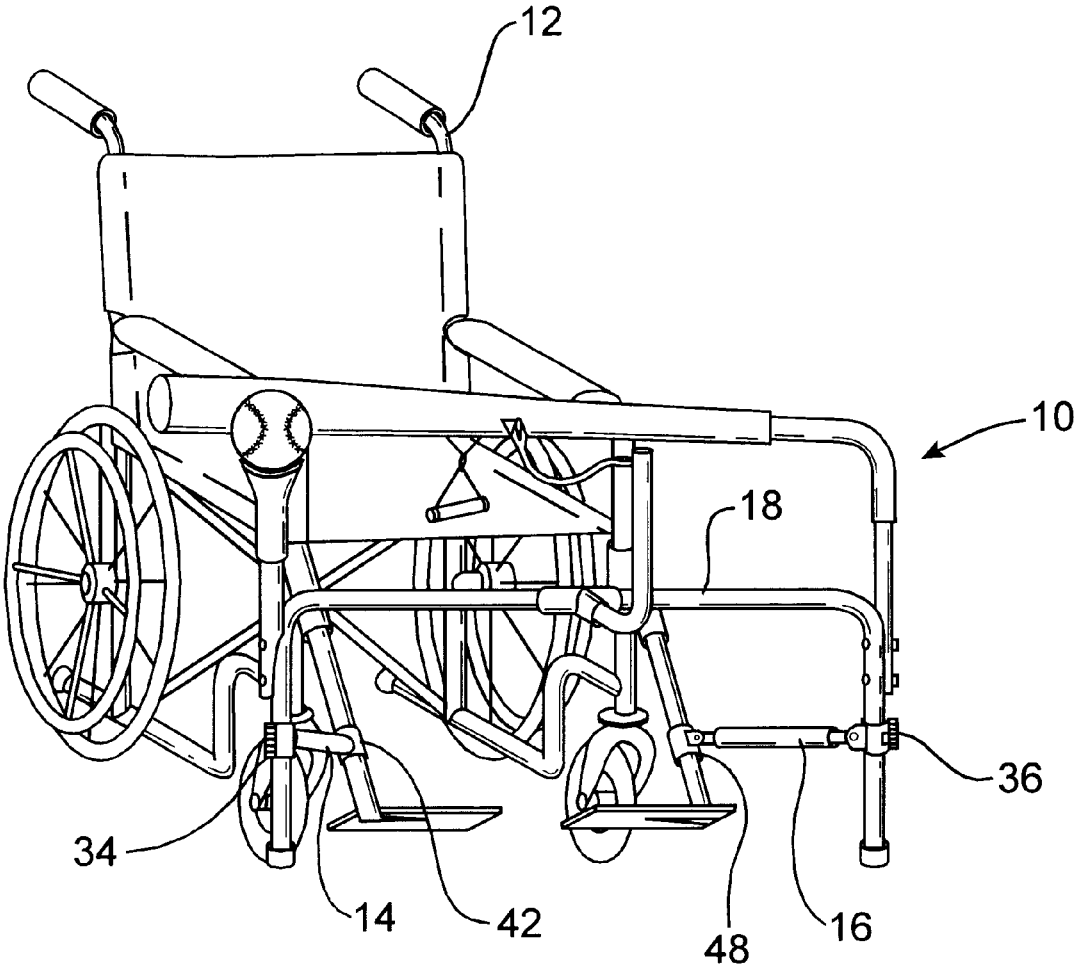
FIG. 1 is a front perspective view of an adaptive physical education device of the present invention shown attached to a wheelchair.

According to the present invention, and as shown in FIG. 1, an adaptive physical education device 10 is disclosed that may be attached to the front of a wheelchair 12. The device 10 is intended to allow handicapped and wheelchair bound people to participate in physical education activities, such as baseball, golf, hockey, basketball and catch, to name a few.

Figure 2:
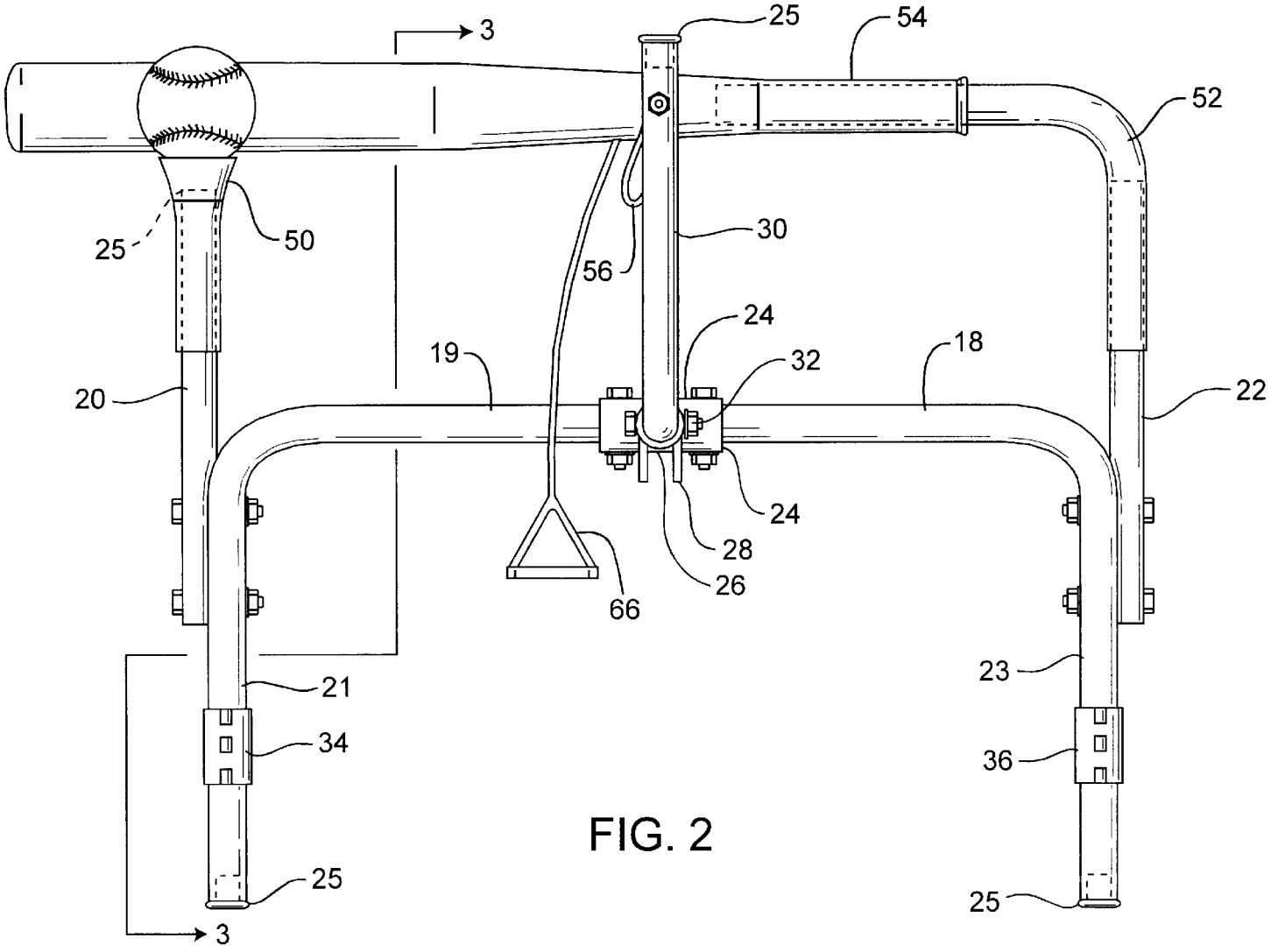
FIG. 2 is a front elevational view of the adaptive physical education device of the present invention with a bat attached to the device.

A first extension 14 and a second extension 16 extend from a support frame 18 to attach the device 10 to the wheelchair 12. As shown in FIG. 2, the frame 18 is essentially "U" shaped and is intended to straddle the wheelchair anterior side. The frame 18 has a first lateral side 21, an opposite second lateral side 23, with both lateral sides 21 and 23 connected by a midsection 19. Extending vertically from the first lateral side 21 is a first vertical post 20 and an opposite second vertical post 22 extends vertically from the second lateral side 23. Frame caps 25 are placed in the open ends of the frame 18.

Figure 3:
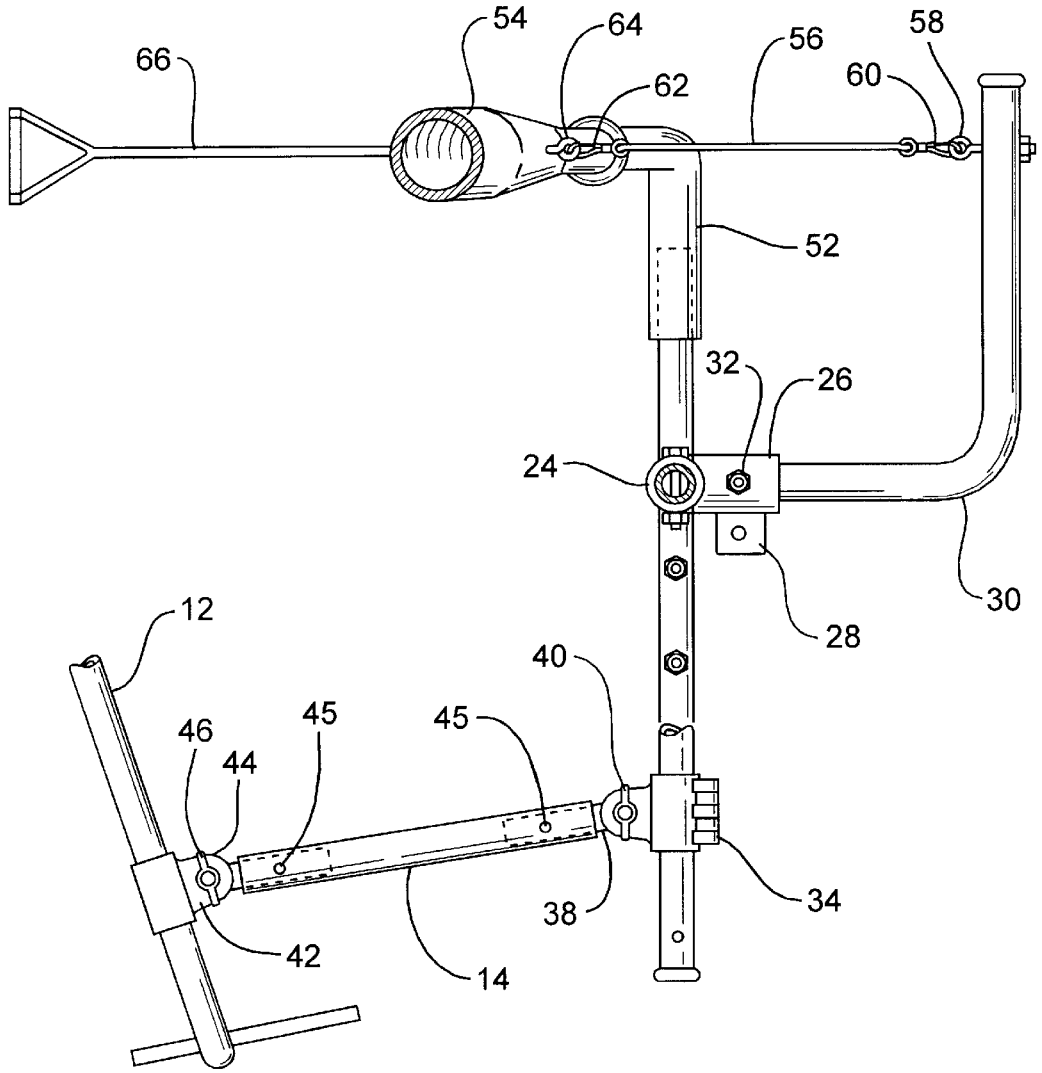
FIG. 3 is a side cross sectional view of the adaptive control device of the present invention taken along line 3—3 from FIG. 2, shown attached to the wheelchair.

At the midsection 19 is a coupling 24. As shown in FIG. 3, extending forward from the coupling 24 is a coupling extension 26 with a hollow bore. Approximately perpendicular to the coupling extension 26 is a coupling bracket 28, which extends downward. A pivotable "L" shaped post 30 is adapted to be placed in the coupling extension 26, and more specifically, the coupling bore. The pivotable post 30 is pinned in place with a pivotable post pin 32, which is placed through the coupling extension 26 and the pivotable post 30. The pivotable post 30 is pivotable and lockable in relation to the frame 18.

As shown in FIG. 3, the frame 18 has a first hinged frame bracket 34 that attaches to the first lateral side 21. An opposite second hinged frame bracket 36 attaches to the frame at the second lateral side 23. A winged nut and bolt arrangement 40 pivotally connects a first frame bracket stud 38 to the first frame bracket 34.

A first hinged wheelchair bracket 42 fastens to the wheelchair frame and is fastened together by a winged nut and bolt arrangement 46. The hinged brackets are designed to wrap around the framework of the wheelchair and the device and then clamp to the framework with the tightening of a nut and bolt. A wheelchair stud 44 pivotally fastens to the wheelchair bracket 42. The wheelchair stud 44 and the frame stud 38 each may be independently adjusted by loosening the nut and bolt arrangement 46 or 40. The first extension 14 slidably attaches to the wheelchair stud 44 and the frame stud 38, as shown in FIG. 3. Locking pins 45 lock the extensions 14 and 16 to the wheelchair studs and the frame studs.

As shown in FIG. 1, a second hinged wheelchair bracket 48 attaches to the second hinged frame bracket 36, with the second extension 16 slidably attaching to another wheelchair stud and frame stud at the second lateral side 23.

Now referring back to FIG. 2, the device 10 is shown outfitted with a bat and a ball. A ball holder 50 slides over the first vertical post 20. A pivotable bat arm 52 slides over the second vertical post 22. A plastic bat 54 is positioned at the terminal end of the pivotable bat arm 52. The arm 52 extends internally through the bat 54 so that the bat 54 is rigid with the arm 52.

As shown in FIG. 3, the bat 54 is attached to the pivotable post 30 by an elongated elastic band 56. The elastic band 56 has a first releasable snap 60 at one end and a second releasable snap 62 at a second end. The first releasable snap 60 attaches to a pivotable post eye bolt 58, which is secured through the pivotable post 30. The second releasable snap 62 attaches to a bat eye bolt 64, which is secured through the bat 54. A handle 66 is also attached to the bat 54 at an opposite side from elastic band 56.

The wheelchair bound participant draws the bat 54 backward toward the wheelchair by pulling on the handle 66, which in turn, applies pressure to the elastic band 56. At the desired point, the participant lets go of the handle 66, the elastic band 56 pulls the bat 54 toward the ball holder 50, which in turn causes the bat 54 to hit the ball. The frame 18 may be adjusted upward or downward by adjusting the wheelchair pivotable brackets 42 and 48, or by adjusting the frame pivotable brackets 34 and 36. The adjustable feature allows the participant to determine if the hit ball would be a grounder or a pop fly, for example. Of course, the participant could point the wheelchair toward first base, second base, or third base, and as the chair pointed, the frame will follow. So the participant has control of the height and the direction of the ball being hit.

Figure 4:
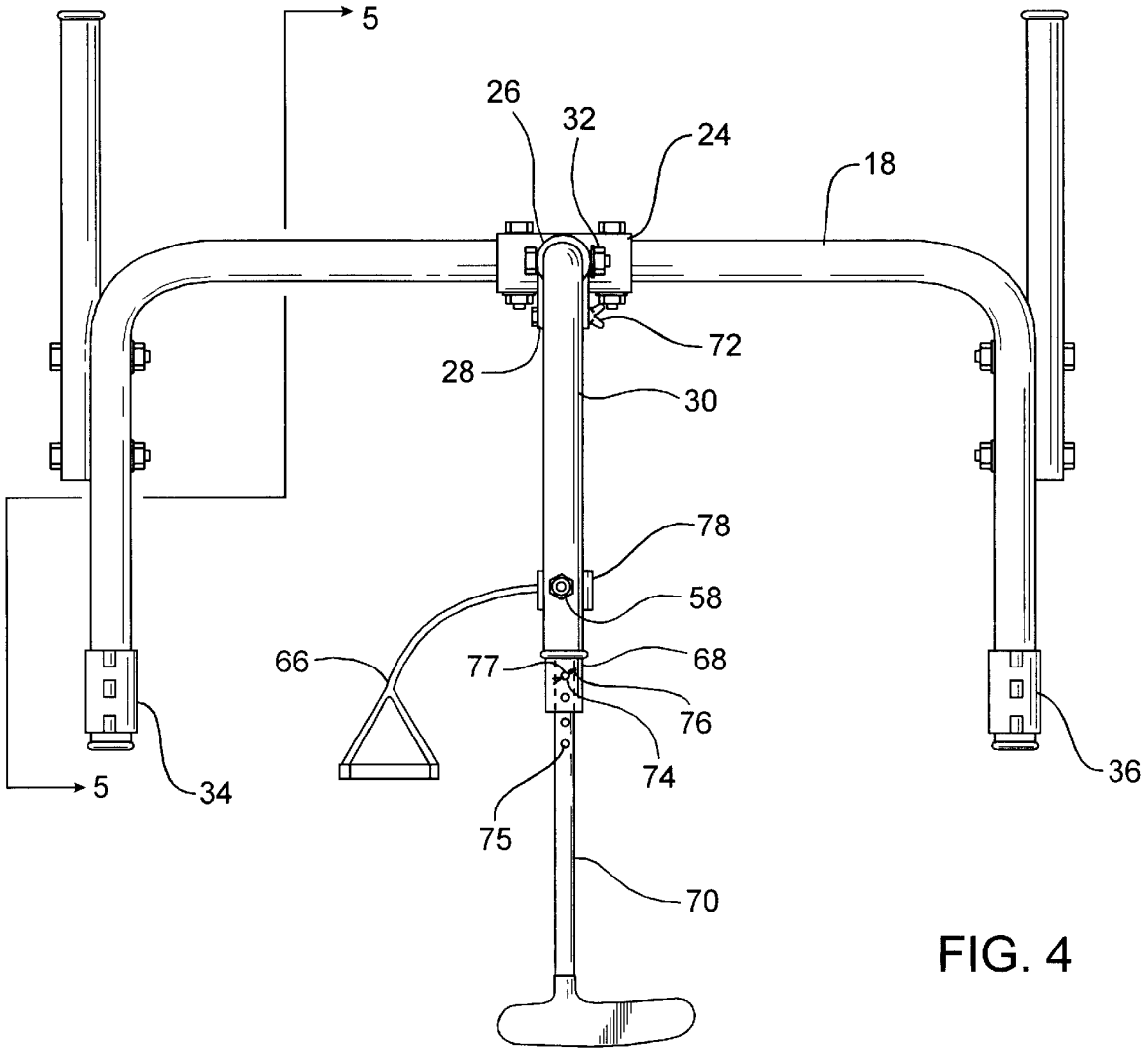
FIG. 4 is a front elevational view of the adaptive physical education device of the present invention with a club attached to the device.
Figure 5:
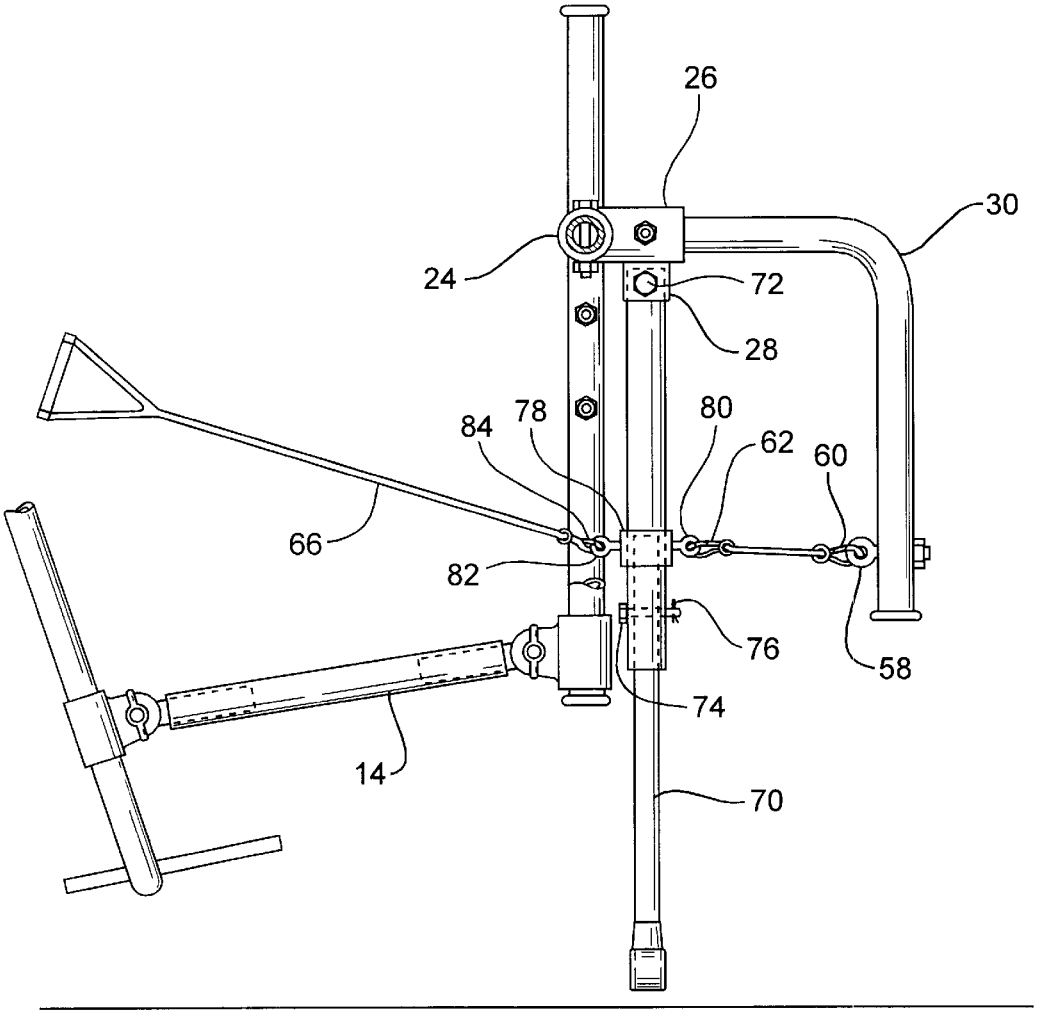
FIG. 5 is a side cross sectional view of the adaptive physical education device of the present invention taken along line 5—5 from FIG. 4, shown attached to the wheelchair.

As shown in FIG. 4 and in FIG. 5, the bat may be removed and the device and may be adapted to fit a club. The pivotable post pin 32 is removed and the pivotable post 30 is rotated 180 degrees, so that the post 30 points downward toward the ground. The pivotable post pin 32 is then replaced to lock the post 30 in the downward position. The club has a top portion 68 and a bottom portion 70. The top portion 68 is positioned in the coupling bracket 28 and is pivotally connected to the coupling bracket 28 with a bolt and nut arrangement 72.

The height of the club may be adjusted by a club pin 74, which is placed through the top and bottom club portions 68 and 70. A plurality of bottom club portion openings 75 are aligned along the length of the bottom portion 70. The top portion 68 has one opening 77; the club top and bottom portions are aligned to the proper club height, the club pin 74 is then placed through the top portion opening 77 and one of the bottom portion openings 75. The club pin 74 is then pinned in place with a cotter pin 76, or any other easily removable pin.

A club bracket 78 is positioned around the top club portion 68. The club bracket 78 has a first eye bolt 80 and a second eye bolt 82. The elastic band 56 is fastened to the club top portion 68 using releasable snaps 60 and 62. The handle 66 also has a releasable snap 84, which is connected to the club bracket second eye bolt 82.

The wheelchair bound participant draws the club 70 backward toward the wheelchair by pulling on the handle 66, which in turn, applies pressure to the elastic band 56. At the desired point, the participant lets go of the handle 66, the elastic band 56 pulls the club 70 toward a golf ball, which in turn causes the club 70 to hit the ball. The frame 18 may be adjusted upward or downward by adjusting the wheelchair pivotable brackets 42 and 48, or by adjusting the frame pivotable brackets 34 and 36. The adjustable feature allows the participant to determine how the club will hit the golf ball.

The club 70 may easily be replaced with a hockey stick, and the ball could easily be replaced with a puck, therefore the device 10 is not limited to golf and baseball. The two stroke or swing motions that the device 10 provides and that are described above, are the two basic swings required in sports: a horizontal swing, as used with baseball, tennis, and racquetball, and a vertical swing, as used with golf, hockey, cricket, and croquet to name a few. The device 10 of the present invention could be adapted with a wide variety of rackets or clubs. A successful prototype has been manufactured using a golf club and a baseball bat, as disclosed and described above.

Figure 6:
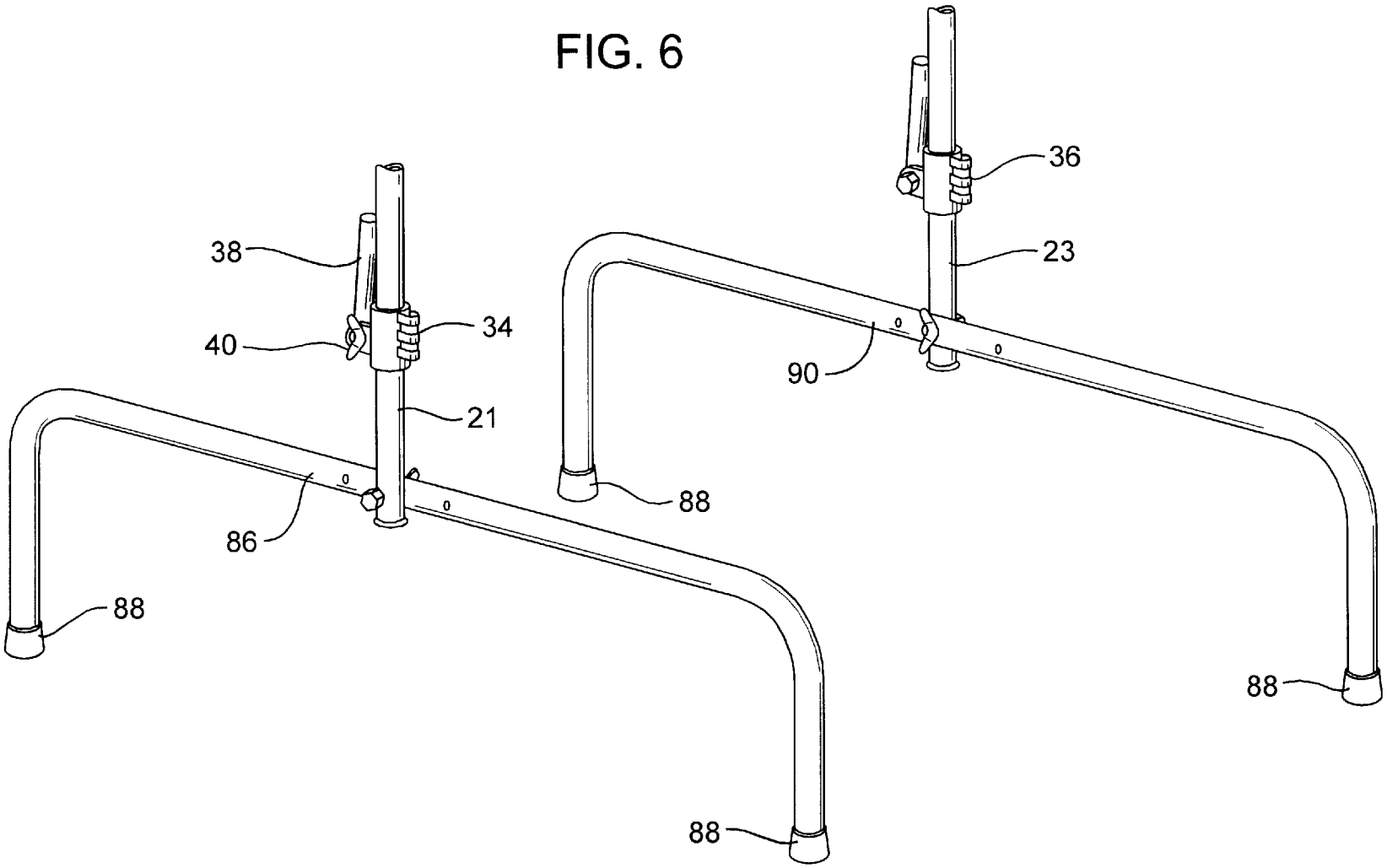
FIG. 6 is a front perspective view of the adaptive physical education device of the present invention, wherein the device is detached from the wheelchair and a pair of stabilizers are attached to the device.

As shown in FIG. 6, if the handicapped or wheelchair participant has the capability to stand up from the wheelchair, the device 10 may be easily modified to be detached from and to be independent of the wheelchair. For example, the extensions 14 and 16 would be disconnected from the wheelchair and the frame 18. The frame bracket studs 38 are then folded against the lateral sides 21 and 23. A first stabilizer 86 is attached to the first lateral side 21 and a second stabilizer 90 is attached to the second lateral side 23. Weights may be added to the stabilizers if needed. Rubber stops 88 are located on the stabilizers 86 and 90 to prevent the device 10 from sliding against the ground.

The stabilizers 86 and 90 allow the participant to stand, hit a ball, and then sit directly back into the wheelchair.

Figure 7:
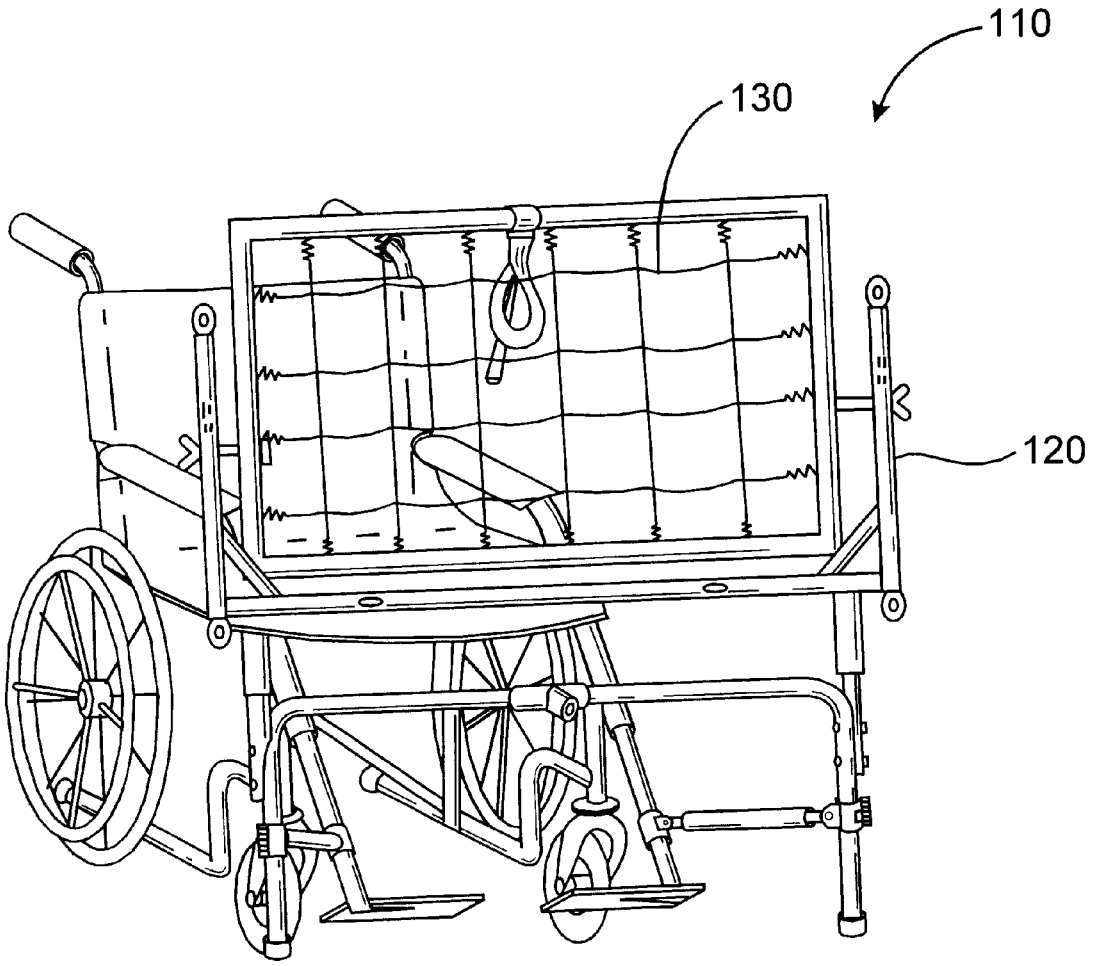
FIG. 7 is a front perspective view of a separate embodiment of the adaptive physical education device of the present invention with a spring-back assembly attached to the front of the wheelchair.
Figure 8:
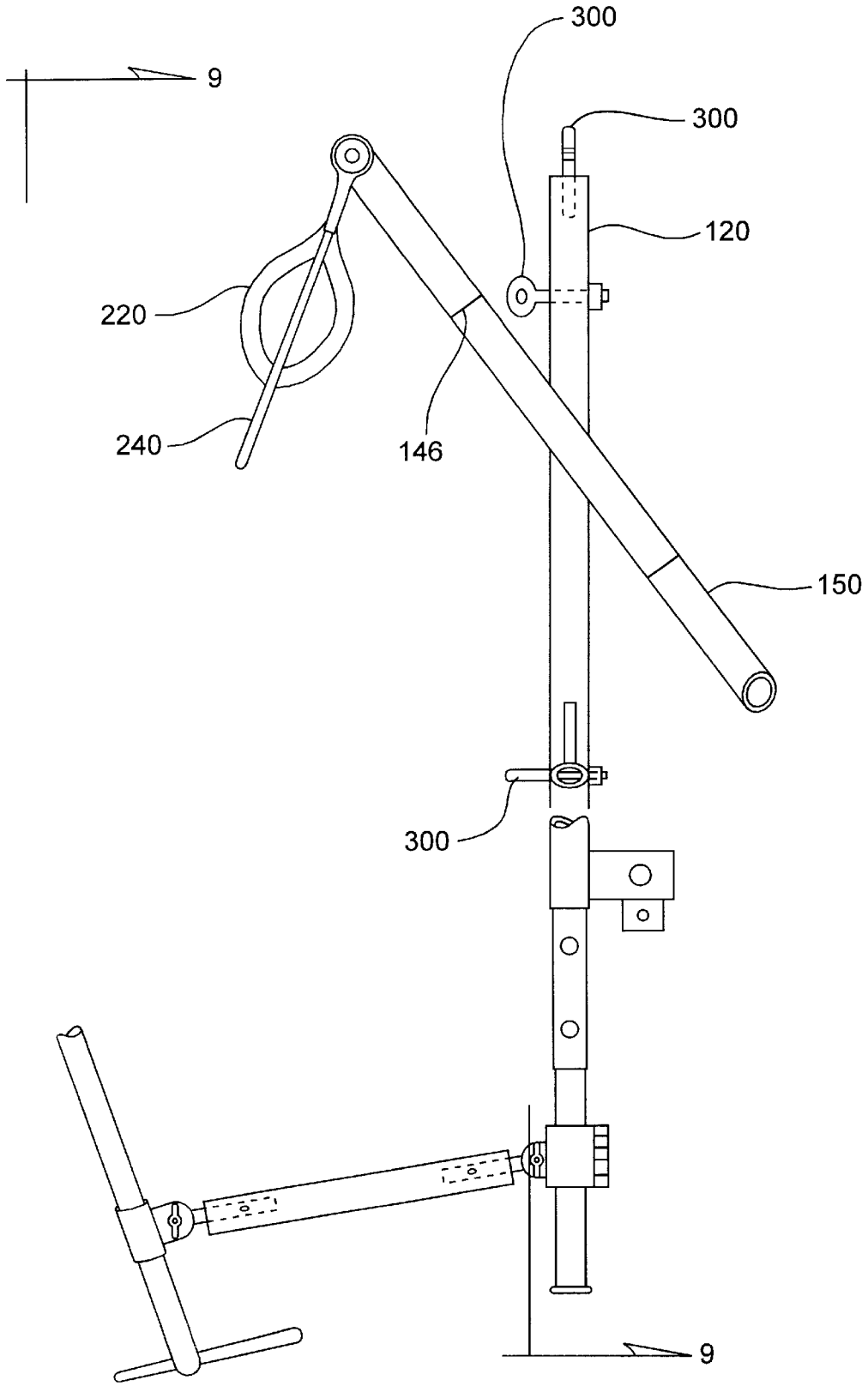
FIG. 8 is side view of the adaptive physical education device of the present invention with the spring-back assembly attached to the wheelchair.
Figure 9:
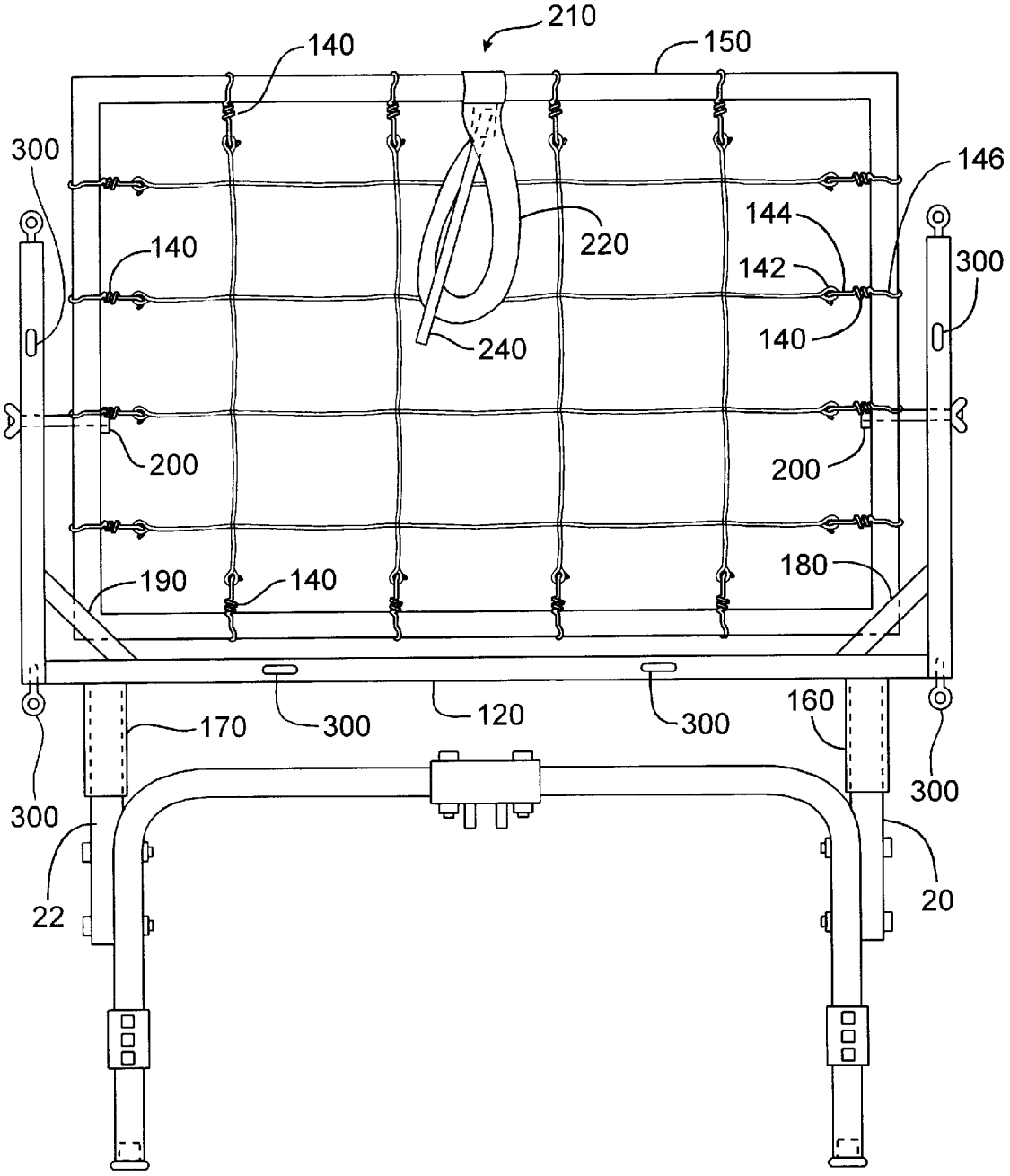
FIG. 9 is a rear or wheelchair view of the spring-back assembly taken along line 9—9 from FIG. 8.
Figure 10:
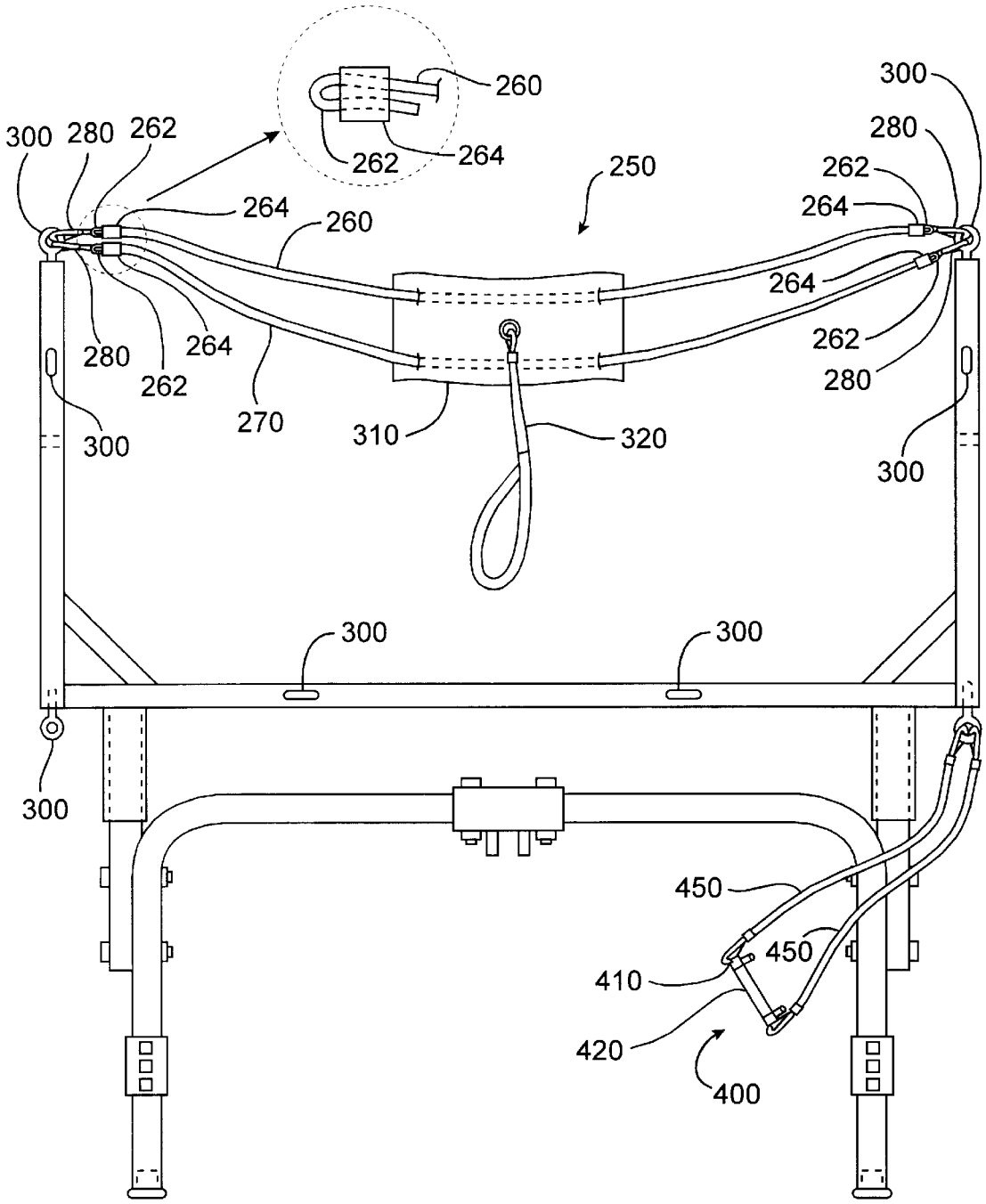
FIG. 10 is a rear or wheelchair view of a separate embodiment of the adaptive physical education device of the present invention showing a ball catapult assembly.
Figure 11:
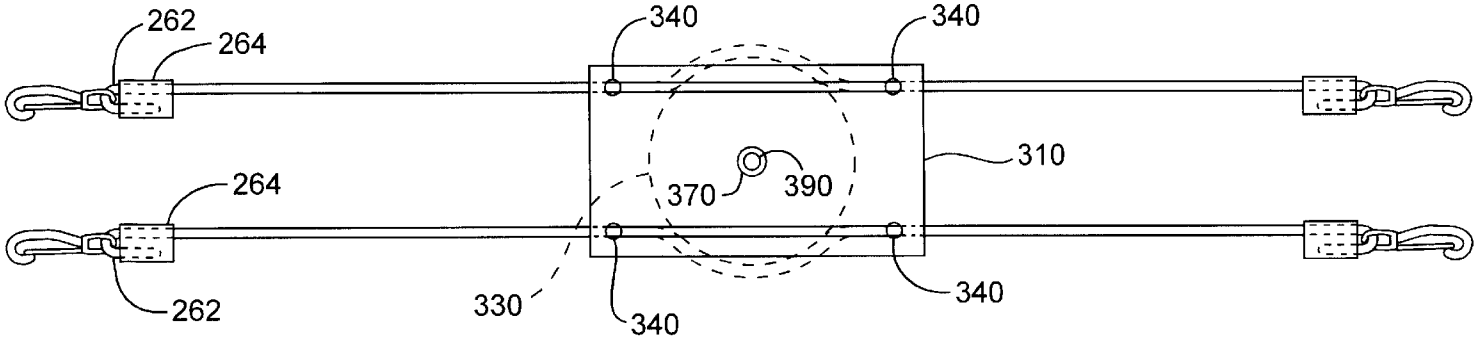
FIG. 11 is a front plan view of a ball holder assembly with a ball shown in phantom

Yet another embodiment is shown in FIGS. 7 through 9, wherein a spring-back assembly 110 with an upright "U" shaped frame 120 is positioned over the first and second vertical posts 20 and 22. A first downward extension 160 and a second downward extension 170 extend downward from the U shaped frame 120 to fit over the first and second vertical posts 20 and 22, respectively. This arrangement creates a unitary assembly of the spring-back assembly 110 to the device 10. The spring-back assembly 110 has a webbing 130, which is attached to a plurality of springs 140, which is in turn attached to a webbing frame 150. The springs 140 have hooks on each side and attach to a webbing loop 142 at a first hook 144 and wrap around the webbing frame 150 at a second hook 146. The webbing 130 is kept relatively tight by the springs 140. The webbing frame 150 is pivotably attached to the U shaped frame 120 by two opposing adjustable through bolts and wing nuts 200. A first through hole is located in the U shaped frame 120 and second through hole is located in the webbing frame 150. The first and second through holes are aligned so as to allow the through bolts and wing nuts 200 to pass through and pivotably attache the U shaped frame 120 and the webbing frame 150. To provide structural support to the frame, a first brace 180 and a second brace 190 are welded to the U shaped frame 120.

The spring-back assembly 110 is adjusted to different angles or loft by loosening the bolts and wing nuts 200, moving the webbing frame 150 to the desired angle relative to the U shaped frame 120, then by tightening the bolts and wing nuts 200. The bolts and wing nuts 200 may also be tightened sufficiently so that the wheelchair participant may adjust the loft of the spring-back assembly 110 by applying force to a push/pull handle 210. The push/pull handle 210 has a looped portion 220 that may be made of nylon and is secured to the webbing frame 150. A relatively rigid rod 240 is attached to the push/pull handle 210 and extends from the looped portion 220. The rod 240 may be adhesively attached or sewn to a portion of nylon material that extends from the looped portion 220. The participant may adjust the spring-back assembly 110 by applying a pushing force to the webbing frame 150 with the rod 240 or by applying a pulling force to the webbing frame 150 with the handle 210. The spring-back assembly 110 is fully utilized when a person tosses a ball to the wheelchair participant with the ball being effectively "caught" by the spring-back assembly and then almost simultaneously catapulted or tossed away from the wheelchair participant. The spring-back assembly is pivotable to different angles so that a ball may be caught and tossed at a variety of angles.

Figure 13:
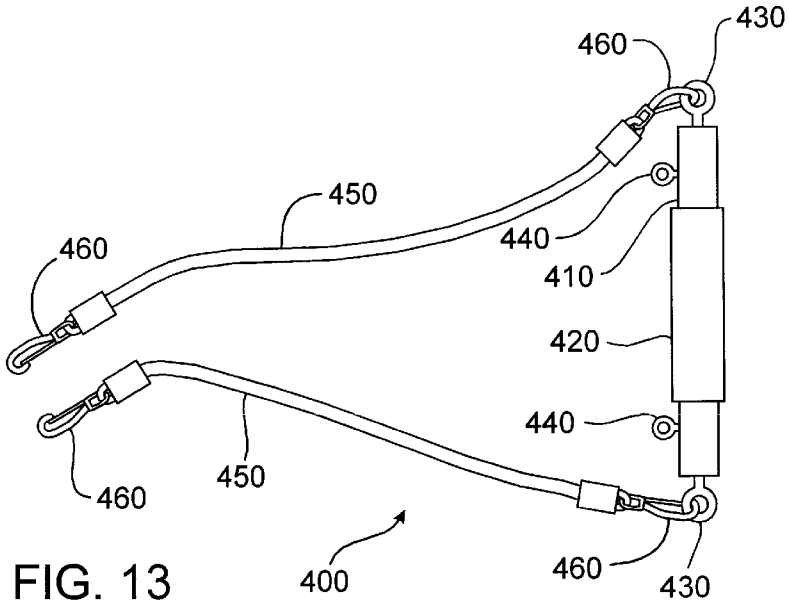
FIG. 13 is a top plan view of a handle used with the ball holder assembly shown in FIG. 11.
Figure 12:
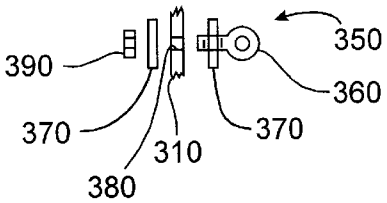
FIG. 12 is an exploded view of an eyebolt assembly used with the ball holder assembly shown in FIG. 11.
Figure 14:
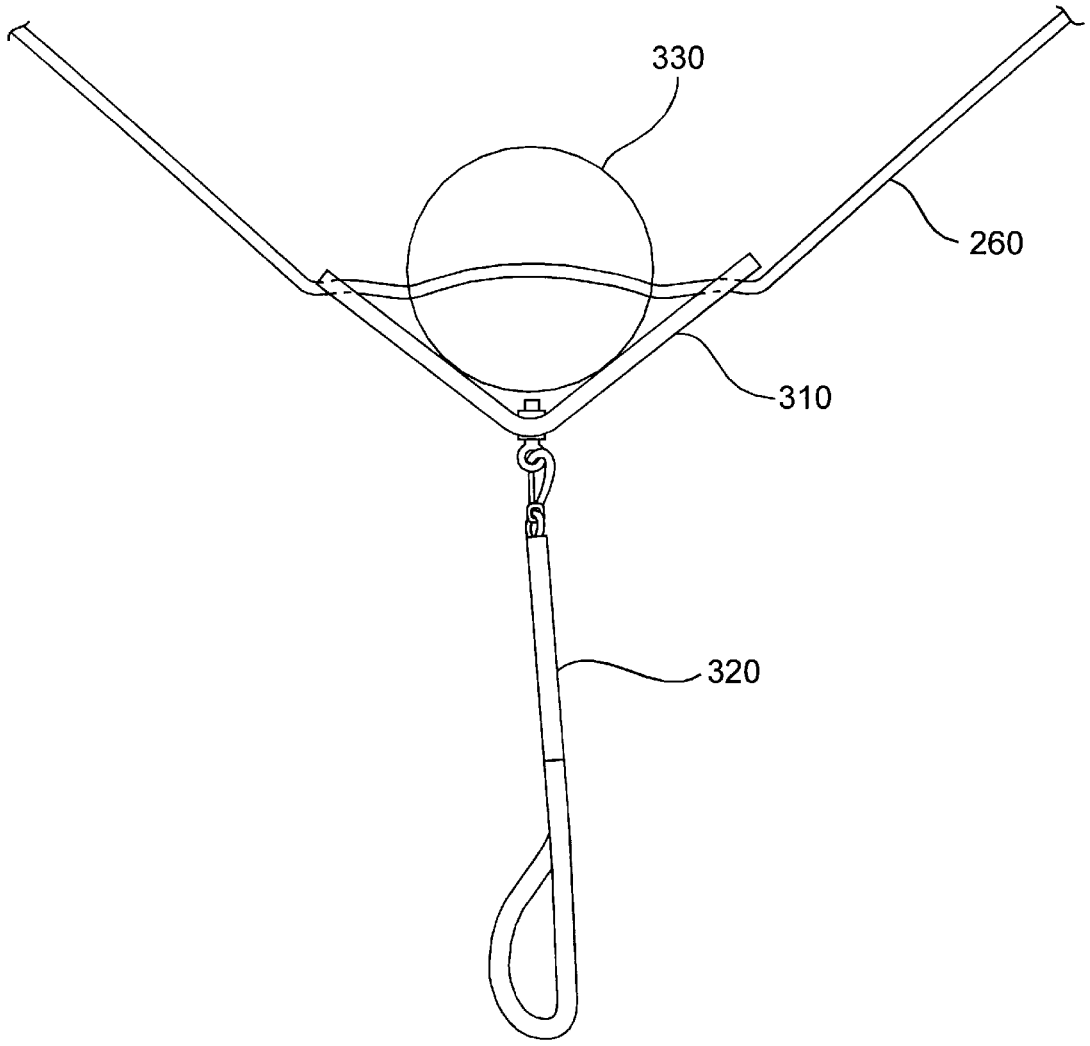
FIG. 14 is a top view of the ball holder assembly in an extended position and holding a ball.

A separate embodiment is shown in FIGS. 10–14, wherein the webbing frame 150 is removed from the spring-back assembly 110 and replaced with a ball catapult assembly 250. The ball catapult assembly 250 is attached to the U shaped frame 120 with a first elastic cord 260 and a second elastic cord 270. The elastic cords have loops 262 at their ends. The loops 262 are accomplished by doubling over the elastic cord at their ends and then fastening the elastic cord to itself by a coupling 264. Snap hooks 280 are securely fastened to the ends of the elastomeric cords 260 and 270. A plurality of eye bolts 300 are secured along the perimeter of the U shaped frame 120, with an eye bolt 300 being located at each end of the upwardly extending "U", so that the elastic cords 260 and 270 are fastened in a manner to span the width of the U shaped frame 120. The ball catapult assembly 250 also has a ball holder portion 310 with a handle 320 attached to the ball holder portion 310. A ball 330 is shown in phantom in FIG. 11 with the first elastomeric cord 260 shown extending above the ball 330 and the second elastomeric cord 270 shown extending below the ball 330. The elastomeric cords 260 and 270 are spaced by the ball holder apertures 340 so as to be stretched enough to secure a ball, typically a basketball, and to release the ball when the ball catapult assembly 250 is released or launched. The ball holder apertures 340 may have different spacings for different size balls. At the center of the ball holder 310 is a fastening assembly 350, shown in FIG. 12, and which comprises an eyebolt 360 with a pair of washers 370 on each side of the ball holder 310. The eyebolt 360 is positioned through a ball holder aperture 380 and secured to the ball holder 310 with nut 390. The two opposing washers 370 distribute the load of the force from the eyebolt 360 through a 10 larger area of the ball holder 310. As shown in FIG. 14, a ball 330 may be placed in the ball holder 310, then the wheelchair bound participant pulls back on the handle 310 to apply tension to the elastic cords 260, then the handle 320 is released so that the ball is catapulted. This embodiment allows the wheelchair bound participant to propel a basketball towards a basketball hoop.

In yet another embodiment, the U shaped frame 120 as described above is utilized with a plurality of eye bolts 460 located around the perimeter of the U shaped frame 120. As shown in FIG. 13, a handle assembly 400 comprises a handle portion 410 with a foam grip 420. The handle portion 410 also has end eyebolts 430 extending from each end of the handle 410. Additionally, side eyebolts 440 extend on the same plane from the handle on each side of the grip 420. A pair of elastic cords 450 are attached to the handle portion 410. Each elastic cord 450 has a snap hook 460 secured to each end of the cord 450. The elastic cords 450 are attached at each end of the handle portion 410 by fastening one snap hook 460 of one end of each cord 450 to one eyebolt 430. The other end of each of the cords 450 is fastened to eyebolt 360. The elastic cords 450 are secured onto one perimeter eye bolt 300 so that the wheelchair bound participant may perform isometric exercises. The handle assembly 400 may be located at any one of a number of perimeter located eyebolts 300 so that the wheelchair participant may perform isometric exercises at a variety of angles to exercise a number of different muscle groups. In addition, more than one pair of elastomeric cords 450 may be secured to the handle assembly 400 and an eyebolt 300 to increase the amount of resistance during the exercises.

Although this invention has been shown and described with respect to a detailed embodiment, those skilled in the art will understand that various changes in form and detail may be made without departing from the spirit and scope of the claimed invention.

We claim:

1. A device to allow a wheelchair participant to propel a ball, wherein the device is attachable to a wheelchair, comprising:

a support frame;

an upright U shaped frame extending from the support frame;

a ball propelling member pivotally attached to said U shaped frame.

2. The device of claim 1, wherein said device further comprises:

a handle attached to said ball propelling member.

3. The device of claim 2, wherein said device further comprises:

at least one elastic cord releasably attached to the U shaped frame and to the ball propelling member, so that as the user pulls back on the handle, the ball propelling member is drawn toward the user, stretching the elastic band so that when the user lets go of the handle, a ball may be propelled.

4. The device of claim 3, wherein said device further comprises:

a ball holder connected to at least one elastic cord; and the handle extending from the ball holder.

5. The device of claim 4, wherein said device further comprises:

a pair of elastic cords connected to the ball holder and to the U shaped frame; and a pair of releasable hooks connecting each end of each elastic cord to the U shaped frame.

6. The device of claim 5, wherein said device further comprises:

the ball holder having a pair of apertures for each elastic cord to space the elastic cords enough to hold a ball in the ball holder.

7. The device of claim 1, wherein said ball propelling member further comprises:

a webbing frame that is pivotally connected to the U shaped frame.

8. The device of claim 7, wherein the ball propelling member further comprises:

a webbing; and a plurality of springs attaching the webbing to the webbing frame.

9. The device of claim 8, wherein the ball propelling member further comprises:

a handle attached to the webbing frame.

10. The device of claim 9, wherein the ball propelling member further comprises:

a rod extending from the handle.

11. The device of claim 7, wherein the ball propelling member further comprises:

a pair of fasteners to pivotally connect the webbing frame to the U shaped frame.

* * * * *